US007101599B2

(12) United States Patent
Moriarty

(10) Patent No.: US 7,101,599 B2
(45) Date of Patent: Sep. 5, 2006

(54) METHOD TO INCREASE BOND STRENGTH AND MINIMIZE NON-UNIFORMITIES OF WOVEN TWO-LAYER MULTIAXIAL FABRICS AND FABRIC PRODUCED ACCORDING TO SAME

(75) Inventor: Michael G. Moriarty, Ballston Lake, NY (US)

(73) Assignee: Albany International Corp., Albany, NY (US)

( * ) Notice: Subject to any disclaimer, the term of this patent is extended or adjusted under 35 U.S.C. 154(b) by 426 days.

(21) Appl. No.: 10/139,557

(22) Filed: May 6, 2002

(65) Prior Publication Data

US 2003/0207069 A1 Nov. 6, 2003

(51) Int. Cl.
*B32B 3/00* (2006.01)
*B32B 23/02* (2006.01)
*D21F 3/00* (2006.01)

(52) U.S. Cl. ..... 428/57; 428/58; 428/192; 116/904

(58) Field of Classification Search ..... 428/57, 428/192, 58, 60; 28/103, 110; 162/358.2, 162/904; 112/402; 283/103, 110
See application file for complete search history.

(56) References Cited

U.S. PATENT DOCUMENTS 4,574,435 A * 3/1986 Luciano et al. ..... 24/33
4,698,250 A * 10/1987 Talonen et al. ..... 428/58
5,217,415 A * 6/1993 Wasylezuck et al. ..... 474/256
5,268,076 A 12/1993 Best et al.
5,360,656 A * 11/1994 Rexfelt et al. ..... 428/193
5,607,757 A * 3/1997 Dalton ..... 442/301
5,713,399 A 2/1998 Collette et al.
5,792,323 A * 8/1998 Grondahl ..... 162/358.4
5,939,176 A 8/1999 Yook
6,124,015 A * 9/2000 Baker et al. ..... 428/99
6,240,608 B1 * 6/2001 Paquin et al. ..... 28/142
6,350,336 B1 * 2/2002 Paquin ..... 156/93
6,440,881 B1 * 8/2002 Ercken ..... 442/320
6,723,208 B1 * 4/2004 Hansen ..... 162/358.2

FOREIGN PATENT DOCUMENTS

EP 0 802 280 B1 10/2001
WO WO 02/29157 4/2002

* cited by examiner

*Primary Examiner*—William P. Watkins, III
*Assistant Examiner*—Patricia L Nordmeyer
(74) *Attorney, Agent, or Firm*—Frommer Lawrence & Haug LLP; Ronald R. Santucci

(57) ABSTRACT

A papermaker's fabric formed of a woven fabric strip. The fabric strip has a width less than a width of the papermaker's fabric, a main portion that is in the form of a multi-layer weave, and two lateral edges that are in the form of weaves having fewer layers than the main portion. The edges are formed such that when the fabric strip is wound around in a continuous spiral fashion to form a papermaker's fabric, the lateral edges overlap one another forming a spiral seam which has a number of layers equal to that of the main portion.

24 Claims, 4 Drawing Sheets

METHOD TO INCREASE BOND STRENGTH AND MINIMIZE NON-UNIFORMITIES OF WOVEN TWO-LAYER MULTIAXIAL FABRICS AND FABRIC PRODUCED ACCORDING TO SAME

BACKGROUND OF THE INVENTION

1. Field of the Invention

The present invention relates to the seaming of fabrics into endless loops for use as paper machine clothing or as a component in paper machine clothing, such as forming, press and dryer fabrics, or as a base for a polymer-coated paper industry process belt, such as a long nip press belt. More specifically, the invention concerns the formation of a spirally continuous seam in the production of wide paper machine clothing from a relatively narrow, spirally wound woven fabric strip.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates primarily to the fabrics used in the press section, generally known as press fabrics, but it may also find application in the fabrics used in the forming and dryer sections, as well as in those used as bases for polymer-coated paper industry process belts, such as, for example, long nip press belts.

Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are used in a wide variety of styles designed to meet the requirements of the paper machines on which they are installed for the paper grades being manufactured. Generally, they comprise a woven base fabric into which has been needled a batt of fine, non-woven fibrous material. The base fabrics may be woven from monofilament, plied monofilament, multifilament or plied multifilament yarns, and may be single-layered, multi-layered or laminated. The yarns are typically extruded from any one of several synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another and by needling a staple fiber batt through both base fabrics to join them to one another. One or both woven base fabrics may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce press fabrics, and other paper machine clothing, to the dimensions required to fit particular positions in the paper machines of their customers. Needless to say, this requirement makes it difficult to streamline the manufacturing process, as each press fabric must typically be made to order.

In response to this need to produce press fabrics in a variety of lengths and widths more quickly and efficiently, press fabrics have been produced in recent years using a spiral winding technique disclosed in commonly assigned U.S. Pat. No. 5,360,656 to Rexfelt et al., the teachings of which are incorporated herein by reference.

U.S. Pat. No. 5,360,656 shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the spirally continuous seam so produced may be closed by sewing, stitching, melting, welding (e.g. ultrasonic) or gluing. Alternatively, adjacent longitudinal edge portions of adjoining spiral turns may be arranged overlappingly, so long as the edges have a reduced thickness, so as not to give rise to an increased thickness in the area of the overlap. Alternatively still, the spacing between lengthwise yarns may be increased at the edges of the strip, so that, when adjoining spiral turns are arranged overlappingly, there may be an unchanged spacing between lengthwise threads in the area of the overlap.

In any case, a woven base fabric, taking the form of an endless loop and having an inner surface, a longitudinal (machine) direction and a transverse (crossmachine) direction, is the result. The lateral edges of the woven base fabric are then trimmed to render them parallel to its longitudinal (machine) direction. The angle between the machine direction of the woven base fabric and the spirally continuous seam may be relatively small, that is, typically less than 10°. By the same token, the lengthwise (warp) yarns of the woven fabric strip make the same relatively small angle with the longitudinal (machine) direction of the woven base fabric. Similarly, the crosswise (filling) yarns of the woven fabric strip, being perpendicular to the lengthwise (warp) yarns, make the same relatively small angle with the transverse (cross-machine) direction of the woven base fabric. In short, neither the lengthwise (warp) nor the crosswise (filling) yarns of the woven fabric strip align with the longitudinal (machine) or transverse (cross-machine) directions of the woven base fabric.

Commonly assigned U.S. Pat. No. 5,713,399 to Collette et al., the teachings of which are incorporated herein by reference, shows a further approach to forming and closing the spirally continuous seam in a fabric of this type. According to the disclosed method, the fabric strip has a lateral fringe along at least one lateral edge thereof, the lateral fringe being unbound ends of its crosswise yarns extending beyond the lateral edge. During the spiral winding of the fringed strip, the lateral fringe of a turn overlies or underlies an adjacent turn of the strip, the lateral edges of the adjacent turns abutting against one another. The spirally continuous seam so obtained is closed by ultrasonically welding or bonding the overlying or underlying lateral fringe to the fabric strip in an adjacent turn.

The present invention provides yet another approach toward forming the spirally continuous seam in a fabric of this type.

SUMMARY OF THE INVENTION

Accordingly, the present invention is both a method for manufacturing a papermaker's fabric, and the fabric made in accordance with the method.

A fabric in accordance with the invention is formed of a woven fabric strip. The fabric strip has a width less than a width of the papermaker's fabric, a main portion that is in the form of a multi-layer weave, and two lateral edges that are in the form of weaves having fewer layers than the main portion. The edges are formed such that when the fabric strip is wound around in a continuous spiral fashion to form a papermaker's fabric, the lateral edges overlap one another forming a spiral seam which has a number of layers equal to that of the main portion.

The present invention will now be described in more complete detail with frequent reference being made to the figures identified as follows.

BRIEF DESCRIPTION OF THE DRAWINGS

FIG. 4 shows how the edges of a fabric strip in accordance with the invention come together to form the fabric construction depicted in FIG. 3; and.

DETAILED DESCRIPTION OF THE PREFERRED EMBODIMENT

Figure 1:
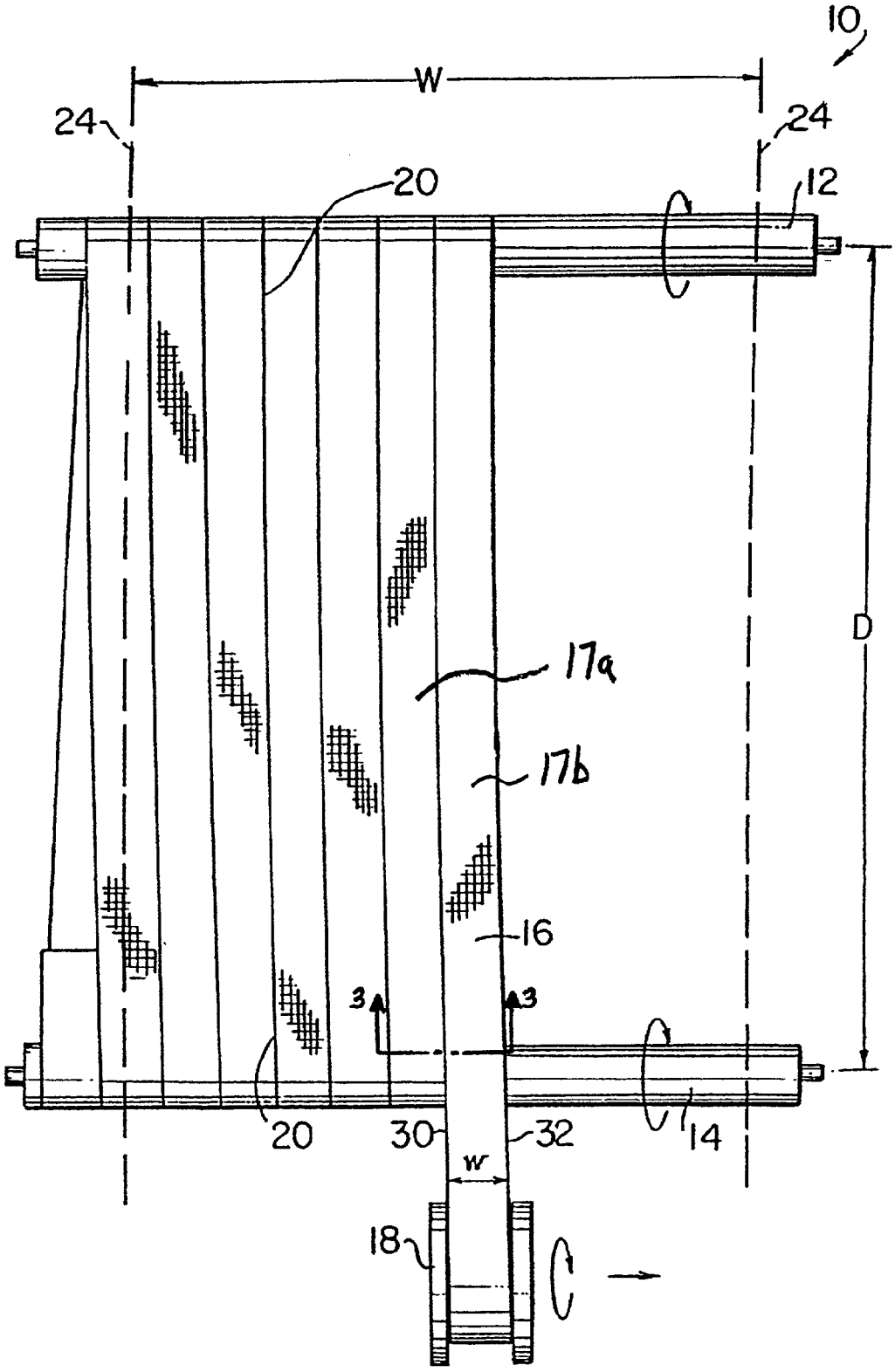
FIG. 1 is a schematic top plan view illustrating a method for manufacturing a papermaker's fabric.

Referring now to the several figures, FIG. 1 is a schematic top plan view illustrating a method for manufacturing a papermaker's fabric. The method may be practiced using an apparatus 10 comprising a first roll 12 and a second roll 14, which are parallel to one another and which may be rotated in the directions indicated by the arrows. A woven fabric strip 16 is wound from a stock roll 18 around the first roll 12 and the second roll 14 in a continuous spiral. It will be recognized that it may be necessary to translate the stock roll 18 at a suitable rate along second roll 14 (to the right in FIG. 1) as the fabric strip 16 is being wound around the rolls 12, 14. The fabric forms a multiple of "turns" as it is wound around rolls 12 and 14. Two of these turns, turns 17*a* and 17*b*, are delineated for purposes of illustration.

Figure 2:
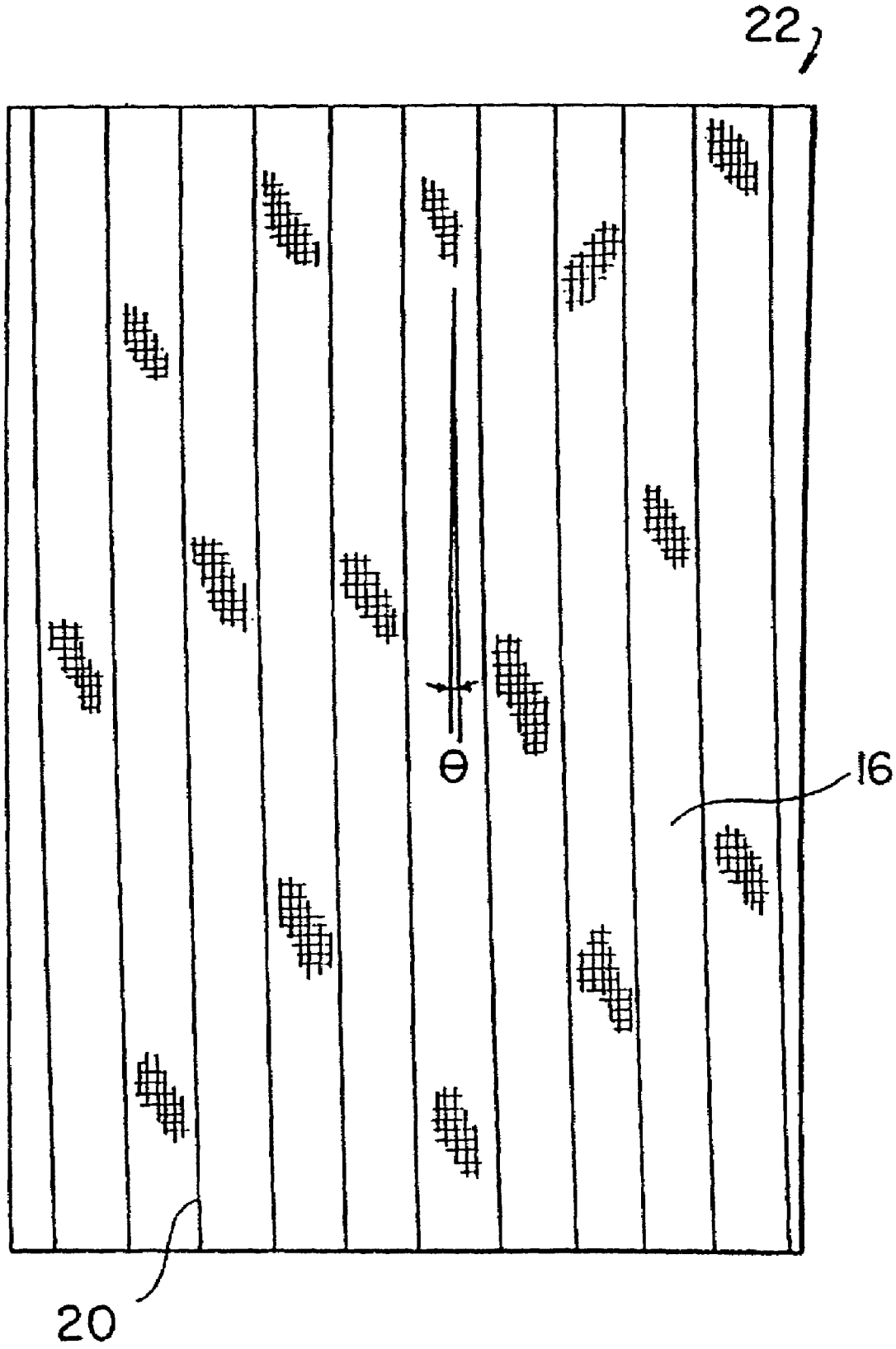
FIG. 2 is a top plan view of the finished papermaker's fabric.

The first roll 12 and the second roll 14 are separated by a distance D, which is determined with reference to the total length required for the papermaker's fabric being manufactured, the total length being measured longitudinally (in the machine direction) about the endless-loop form of the papermaker's fabric. Woven fabric strip 16, having a width w, is spirally wound onto the first and second rolls 12, 14 in a plurality of turns from stock roll 18, which may be translated along the second roll 14 in the course of the winding. Successive turns of the fabric strip 16 are disposed relative to one another in the manner to be illustrated below, and are attached to one another along spirally continuous seam 20 by sewing, stitching, melting, welding (e.g. ultrasonic) or gluing, to produce papermaker's fabric 22 as shown in FIG. 2. When a sufficient number of turns of the fabric strip 16 have been made to produce a papermaker's fabric 22 of desired width W, that width being measured transversely (in the cross-machine direction) across the endless-loop form of the papermaker's fabric 22, the spiral winding is concluded. The papermaker's fabric 22 so obtained has an inner surface, an outer surface, a machine direction and a cross-machine direction. Initially, the lateral edges of the papermaker's fabric 22, it will be apparent, will not be parallel to the machine direction thereof, and must be trimmed along lines 24 to provide the papermaker's fabric 22 with the desired width W, and with two lateral edges parallel to the machine direction of its endless-loop form.

Fabric strip 16 may be woven from monofilament, plied monofilament or multifilament yarns of a synthetic polymeric resin, such as polyester or polyamide, in the same manner as other fabrics used in the papermaking industry are woven. After weaving, it may be heatset in a conventional manner prior to interim storage on stock roll 18. Fabric strip 16 includes lengthwise yarns and crosswise yarns, wherein, for example, the lengthwise yarns may be plied monofilament yarns while the crosswise yarns may be monofilament yarns. Further, fabric strip 16 may be of a multi-layer weave, or may be of a combination of single-layer and multi-layer weaves. Preferably, the fabric strip has a main portion that is of a double-layer weave and has lateral edges that are of a single-layer weave.

Alternatively, fabric strip 16 may be woven and heatset in a conventional manner, and fed directly to apparatus 10 from a heatsetting unit without interim storage on a stock roll 18. It may also be possible to eliminate heatsetting with the proper material selection and product construction (weave, yarn sizes and counts). In such a situation, fabric strip 16 would be fed to the apparatus 10 from a weaving loom without interim storage on a stock roll 18.

Figure 3:
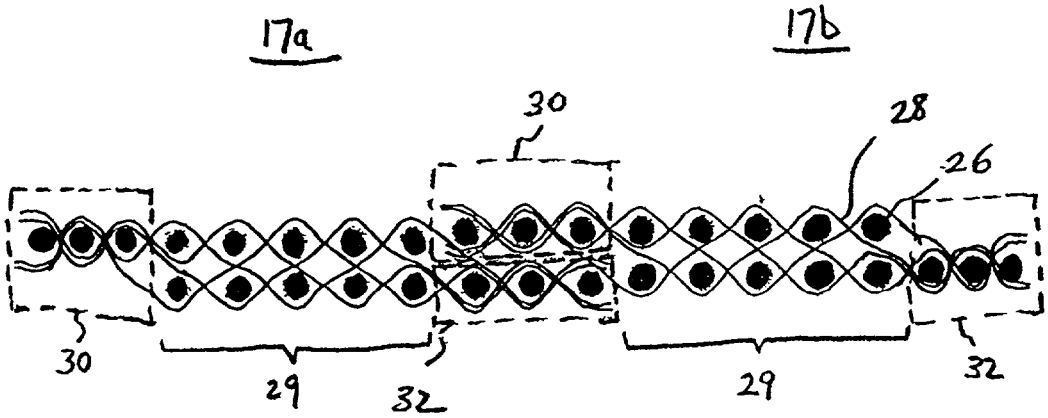
FIG. 3 is an enlarged cross-sectional view taken as indicated by line 3—3 in FIG. 1 in accordance with one possible embodiment of the invention.

FIG. 3 is a cross section of fabric strip 16 taken as indicated by line 3—3 in FIG. 1. It comprises lengthwise yarns 26 and crosswise yarns 28, both of which are represented as monofilaments, interwoven in a double-layer weave. More specifically, a four-shed weave is shown, although, it should be understood, the fabric strip 16 may be woven according to any of the multi-layer weave patterns commonly used to weave paper machine clothing. Because the fabric strip 16 is spirally wound to assemble papermaker's fabric 22, lengthwise yarns 26 and crosswise yarns 28 do not align with the machine and cross-machine directions, respectively, of the papermaker's fabric 22. Rather, the lengthwise yarns 26 make a slight angle, θ, whose magnitude is a measure of the pitch of the spiral windings of the fabric strip 16, with respect to the machine direction of the papermaker's fabric 22, as suggested by the top plan view thereof shown in FIG. 2. This angle, as previously noted, is typically less than 10°. Because the crosswise yarns 28 of the fabric strip 16 generally cross the lengthwise yarns 26 at a 90° angle, the crosswise yarns 28 make the same slight angle, θ, with respect to the cross-machine direction of the fabric 22.

As can be seen from FIG. 3, woven fabric strip 16 has a main portion 29, a first lateral edge 30 and a second lateral edge 32. In FIG. 3, the portion of the first lateral edge that is depicted is the portion belonging to turn 17*a* of strip 16. The portion of the second lateral edge that is depicted belongs to turn 17*b* of strip 16.

Figure 4:
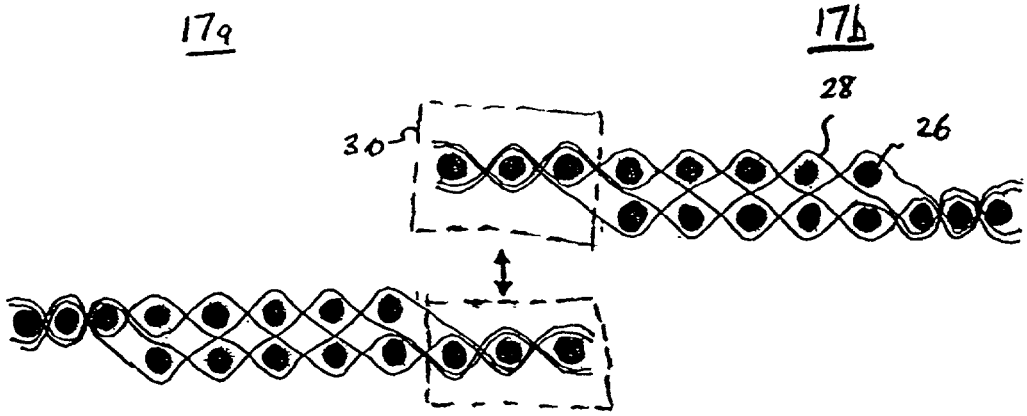

FIG. 4 is an enlarged cross-sectional view showing how turns 17*a* and 17*b* come together to form the structure of FIG. 3. That is, the portion of lateral edge 30 belonging to turn 17*b* overlaps with the portion of lateral edge 32 belonging to turn 17*a* and the single-layer weave of the respective edges forms a lap joint with a resulting double-layer form. The lateral edges of the two turns are stitched together, preferably using a series of standard straight stitches. Other ways of joining including sewing, melting, welding (e.g. ultrasonic) and/or gluing may also be utilized. By joining the turns in this fashion, the joint formed by the overlapping portions takes on the same form as the main body of the fabric strip. This type of joining is preferably performed along the entire length of seam 20 to realize a flatter, more durable papermaker's fabric. A papermaker's fabric formed in this manner does not appear to have a seam, but rather, appears to be formed of one continuous fabric of double layer construction.

Figure 5:
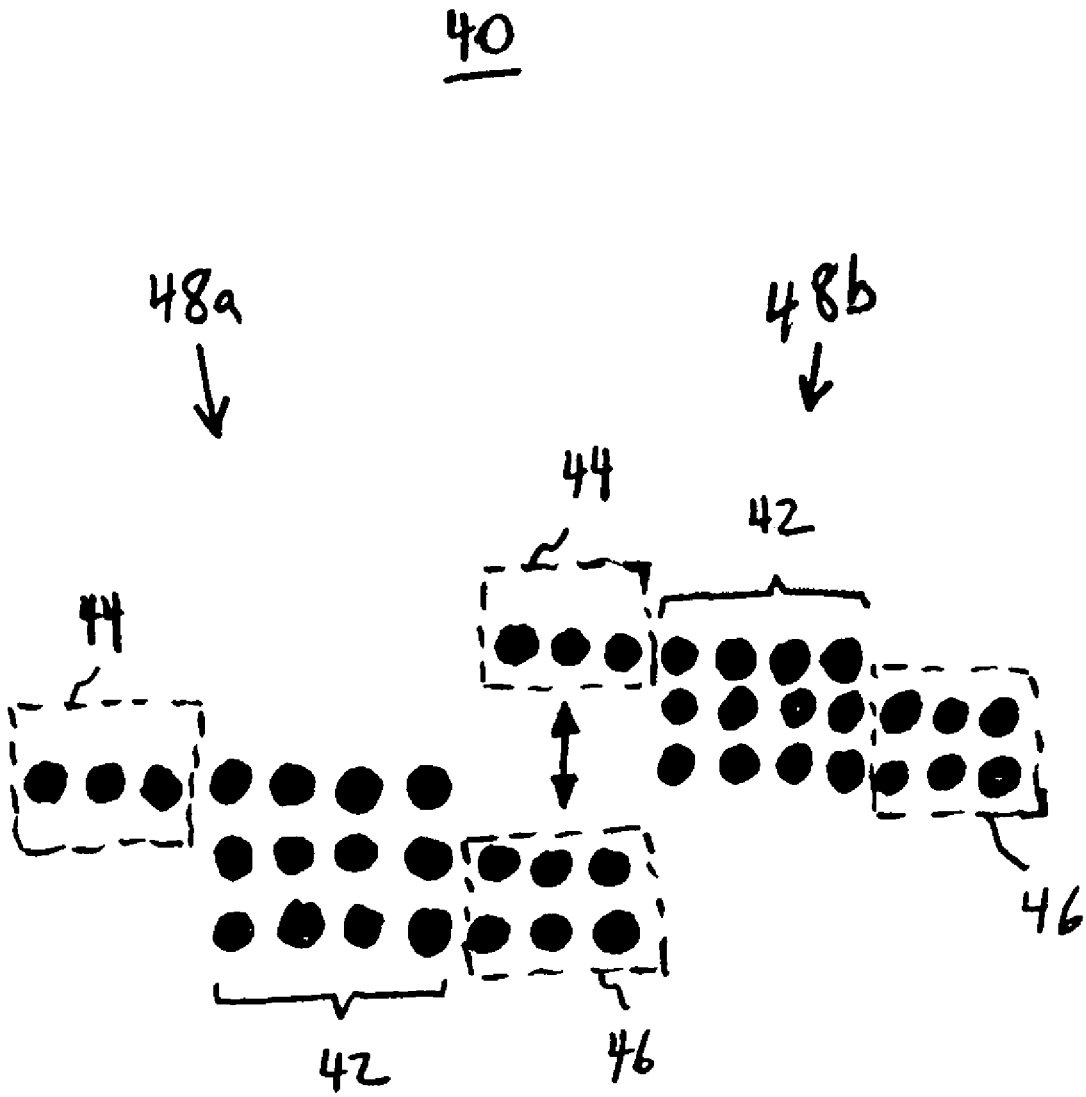
FIG. 5 shows an alternative embodiment of the invention wherein a main portion of a fabric strip is of a multi-layer weave having more than two layers and lateral edge portions of the strip are each of a weave having fewer layers than the main portion.

In an alternative embodiment, the main portion of the fabric strip is of a multi-layer weave having more than two layers, with the lateral edges each being of a weave fewer layers than the main portion. FIG. 5 illustrates such an alternative embodiment. As shown in FIG. 5, a fabric strip 40 is provided, having a main body 42 that is of a triple-layer weave, a first lateral edge 44 that is of a single-layer weave, and a second lateral edge 46 that is of a double-layer weave. Two turns, 48*a* and 48*b* of the strip are depicted. Only the lengthwise yarns, and not the crosswise yarns, are shown for purposes of clarity of presentation. As can be seen from FIG. 5, when edges 44 and 46 of turns 48*a* and 48*b* are brought together they form a lap joint with a triple-layer form; thereby providing a joint that has a structure like that of main body 42 of strip 40.

In any event, the number of layers in the main portion and edge portions should be such that when the fabric strip is wound around in a continuous spiral fashion to form a papermaker's fabric, the resulting seam portion appears as a continuation of the main portion. Further, adjacent turns of the spirally wound fabric strip need not be attached to one another by stitching. Other attachment methods include sewing, melting, welding and gluing, as aforesaid, may be utilized.

Furthermore, as an option, one or more of the crosswise yarns in either or both of the lateral edge regions of the fabric strip may be removed such that upon joining lateral edges of the strip the density of crosswise yarns in the joint region will be the same or, substantially the same, as the density of crosswise yarns in the main body region. For example, in the configuration depicted in FIGS. 2 and 3 every other yarn of crosswise yarns 28 could be removed from edges 30 and 32 so that when edges 30 and 32 are overlapped, the number of crosswise yarns in the overlap area would be the same as the number of crosswise yarns in main body 30. In this manner, not only will the number of layers in the joint be the same as the number of layers in the main body, but the crosswise yarn density in the joint will be the same as the crosswise yarn density in the main body. It is noted that the number of crosswise yarns removed from one edge may differ from the number of crosswise yarns removed from the other edge, as long as the desired crosswise yarn density of the joint is achieved. Of course, the same result may be achieved by removing crosswise yarns from only one of the edges.

Modifications to the above would be obvious to those of ordinary skill in the art, but would not bring the invention so modified beyond the scope of the appended claims.

What is claimed is:

1. A papermaker's fabric formed of a woven fabric strip having a width that is less than a width of the papermaker's fabric, the fabric strip comprising a main portion that is in the form of a multi-layer weave comprising two or more layers of lengthwise and crosswise yarns and two lateral edges that are in the form of weaves having at least one layer of lengthwise and crosswise yarns less than the main portion; wherein the fabric strip is wound around in a continuous spiral fashion to form the papermaker's fabric, and the lateral edges overlap one another to form a spiral seam which has a number of layers equal to that of the main portion with the joining surfaces of said overlapping edges being substantially smooth.

2. A papermaker's fabric as claimed in claim 1 wherein the main portion is in the form of a double-layer weave.

3. A papermaker's fabric as claimed in claim 2 wherein the lateral edges are each in the form of a single-layer weave.

4. A papermaker's fabric as claimed in claim 1 wherein the main portion and the lateral edges are woven from lengthwise yarns and crosswise yarns.

5. A papermaker's fabric as claimed in claim 4 wherein the lengthwise yarns and crosswise yarns are of a synthetic polymeric resin.

6. A papermaker's fabric as claimed in claim 4 wherein the lengthwise yarns of the fabric strip make an angle of less than 10° with respect to a machine direction of the papermaker's fabric.

7. A papermaker's fabric as claimed in claim 4 wherein a portion of the crosswise yarns in one or more of the lateral edges is removed such that the density of crosswise yarns in the spiral seam is approximately the same as the density of crosswise yarns in the main portion.

8. A papermaker's fabric as claimed in claim 1 wherein adjacent turns of the spirally wound fabric strip are attached to one another by a process selected from the group consisting of sewing, stitching, melting, welding and gluing.

9. A method for forming a papermaker's fabric, comprising the steps of:

providing a woven fabric strip having a width less than a width of the papermaker's fabric, a main portion that is in the form of a multi-layer weave comprising two or more layers of lengthwise and crosswise yarns and two lateral edges that are in the form of weaves having at least one layer of lengthwise and crosswise yarns less than the main portion; and winding the fabric strip in a continuous spiral fashion to form the papermaker's fabric such that the lateral edges overlap one another to form a spiral seam which has a number of layers equal to that of the main portion with the joining surfaces of said overlapping edges being substantially smooth.

10. A method for forming a papermaker's fabric as claimed in claim 9 wherein the main portion is in the form of a double-layer weave.

11. A method for forming a papermaker's fabric as claimed in claim 10 wherein the lateral edges are each in the form of a single-layer weave.

12. A method for forming a papermaker's fabric as claimed in claim 10 wherein adjacent turns of the spirally wound fabric strip are attached to one another by a process selected from the group consisting of sewing, stitching, melting, welding and gluing.

13. A method for forming a papermaker's fabric as claimed in claim 9 wherein the main portion and the lateral edges are woven from lengthwise yarns and crosswise yarns.

14. A method for forming a papermaker's fabric as claimed in claim 13 wherein the lengthwise yarns and crosswise yarns are of a synthetic polymeric resin.

15. A method for forming a papermaker's fabric as claimed in claim 13 wherein the lengthwise yarns of the fabric strip make an angle of less than 10° with respect to a machine direction of the papermaker's fabric.

16. A papermaker's fabric as claimed in claim 13 wherein a portion of the crosswise yarns in one or more of the lateral edges is removed such that the density of crosswise yarns in the spiral seam is approximately the same as the density of crosswise yarns in the main portion.

17. A papermaker's fabric formed of a woven fabric strip having a width that is less than a width of the papermaker's fabric, the fabric strip comprising a main portion that is in the form of a multi-layer weave comprising two or more layers of lengthwise and crosswise yarns and two lateral edges that are in the form of weaves having at least one layer of lengthwise and crosswise yarns less than the main portion; wherein the papermaker's fabric is formed by winding the fabric strip in a continuous spiral such that the lateral edges overlap one another to form a spiral seam which has a number of layers equal to that of the main portion with the joining surfaces of said overlapping edges being substantially smooth.

18. A papermaker's fabric as claimed in claim 17 wherein the main portion is formed by weaving in a double-layer configuration.

19. A papermaker's fabric as claimed in claim 18 wherein the lateral edges are formed by weaving in a single-layer configuration.

20. A papermaker's fabric as claimed in claim 17 wherein the main portion and the lateral edges are formed by weaving lengthwise yarns and crosswise yarns.

21. A papermaker's fabric as claimed in claim 20 wherein the lengthwise yarns and crosswise yarns are formed by using a synthetic polymeric resin.

22. A papermaker's fabric as claimed in claim 20 wherein the lengthwise yarns of the fabric strip are woven such that they make an angle of less than 10° with respect to a machine direction of the papermaker's fabric.

23. A papermaker's fabric as claimed in claim 20 wherein a portion of the crosswise yarns in one or more of the lateral edges is removed such that the density of crosswise yarns in the spiral seam is approximately the same as the density of crosswise yarns in the main portion.

24. A papermaker's fabric as claimed in claim 17 wherein adjacent turns of the spirally wound fabric strip are attached to one another by a process selected from the group consisting of sewing, stitching, melting, welding and gluing.

* * * * *